US006588746B2

(12) United States Patent
Dobrindt et al.

(10) Patent No.: US 6,588,746 B2
(45) Date of Patent: Jul. 8, 2003

(54) DEVICE FOR GENERATING AN OFFSET OF TRANSPORTED FLEXIBLE SHEET MATERIAL

(75) Inventors: Dirk Dobrindt, Klausdorf/Schwentine (DE); Uwe Fischer, Rostock (DE)

(73) Assignee: NexPress Solutions LLC, Rochester, NY (US)

( * ) Notice: Subject to any disclaimer, the term of this patent is extended or adjusted under 35 U.S.C. 154(b) by 51 days.

(21) Appl. No.: 09/989,789

(22) Filed: Nov. 20, 2001

(65) Prior Publication Data

US 2002/0063379 A1 May 30, 2002

(30) Foreign Application Priority Data

Nov. 28, 2000 (DE) ..... 100 59 004

(51) Int. Cl.[7] ..... B65H 29/00
(52) U.S. Cl. ..... 271/285; 399/404
(58) Field of Search ..... 271/285, 286; 399/404; B65H 29/00

(56) References Cited

U.S. PATENT DOCUMENTS 2,821,387 A 1/1958 Faeber
5,512,996 A * 4/1996 Fare ..... 399/404
6,059,285 A 5/2000 Suga et al. ..... 271/228
6,480,697 B2 * 11/2002 Kojima ..... 399/404
6,511,063 B1 * 1/2003 Dickhoff et al. ..... 271/184

FOREIGN PATENT DOCUMENTS

DE 1 574 386 3/1973
DE 26 38 022 3/1978
DE 39 19 403 C1 9/1990
JP 2000-351520 * 12/2000 ..... B65H/33/06

* cited by examiner

*Primary Examiner*—Donald P. Walsh
*Assistant Examiner*—Kenneth W Bower
(74) *Attorney, Agent, or Firm*—Lawrence P. Kessler

(57) ABSTRACT

The invention relates to a device (1) for generating an offset (2) of transported flexible sheet material (3), especially sheets of paper, with a feeding and a discharging transport path section (5 and 7) and a transport path section (6) which is assigned to the offset generating means (10). These devices of the prior art often require a control, resetting of the offset generating means after each sheet of material (3) or they do not operate independently of format. The invention affords relief by the offset generating means (10) having at least two deflections (8, 9 or 8, 8', 9, 9') which are parallel, which work in opposite directions, and which can be moved to an angle (gamma) to the transport direction (4); this angle is measured in the plane of the feeding transport path section (5) and is not equal to 90° projected onto this plane.

33 Claims, 13 Drawing Sheets

DEVICE FOR GENERATING AN OFFSET OF TRANSPORTED FLEXIBLE SHEET MATERIAL

FIELD OF THE INVENTION

The invention relates to a device for generating an offset of transported flexible sheet material, especially sheets of paper, with a feeding and a discharging transport path section and a transport path section which is assigned to the offset generating means.

BACKGROUND OF THE INVENTION

One device for producing an offset can be used to deposit offset a certain number of sheets at a time in a delivery stack of a printing machine in order, for example, to separate the sheets of one job from another. But this offset can also be used to correct the deposition of individual sheet materials with respect to the exactness of the position in order to obtain a perfect delivery stack. There are devices of the initially mentioned type in the most varied versions. Side stops, crossover conveyor means with rollers or balls which are located transversely to the transport direction or slantwise to it or with transversely movable drums have been proposed. DE 43 13 840 C1 is named by way of example for the latter proposal.

These proposals generally require complex control and often return of the offset generating device which is made as a crossover conveyor means to its original position, as is the case in the subject matter of DE 43 13 840 C1. Many of these proposals are not independent of the paper format; this necessitates detection and consideration of the format.

SUMMARY OF THE INVENTION

Therefore the object of the invention is to make available an easily adjustable device for generating an offset of transported flexible sheet material which works without the reset requirements and independently of format. The object is achieved by the offset generating device having at least two deflections which are parallel and which work in opposite directions and which can be moved to an angle $\gamma$ to the transport direction; this angle is measured in the plane of the feeding transport path section and is not equal to 90° projected onto this plane. The latter relates to the deflections which do not lie in the plane of the feeding transport path section.

In the approach in the invention it is possible to achieve a certain offset by setting a certain angle. In doing so the offset generating device is swiveled out of its initial position, in which the angle $\gamma$ to the transport direction of the material is 90°, by an angle $\alpha$ in one direction or the other, depending on in which direction the material is to be displaced. A control means is not necessary for this purpose, since an offset caused thereby can be directly assigned to the angle. It is therefore enough to calibrate the angle setting with the amount of assigned offset. With this device, within a wide area for which the device can be used with respect to its size, flexible sheet materials can be displaced regardless of their format with respect to the location of their side edges without the need to set the device to the different formats. There is no need to reset the offset generating device after each sheet since the offset generating device works continuously. This also makes it possible to generate an offset not only in sheets, but also continuous webs. Since the mechanism need not be continually reset, it is simpler and less susceptible to problems.

Since it is generally a matter of displacing sheets of a material, the invention proposes that pairs of guide elements are arranged such that the sheets are always held and transported on both sides by at least one pair of guide elements. They can be held either on the outside edges, over the entire width or over the entire surface. If the device is made such that the feeding and discharging transport path sections do not lie on parallel planes, both parallel and also angular offset is achieved; the latter is dependent on the angular position of the planes. But the normal case is that a parallel offset is desired for one of the initially mentioned purposes. Therefore it is proposed that the feeding and discharging transport path sections lie on parallel planes.

One feasible embodiment of the invention calls for the offset generating device to be made as a unit which can be swiveled by an angle $\alpha$. Regardless of the specific configuration of the offset generating means, joint swiveling of all of the parts which must be swiveled to generate the offset can be done.

One embodiment calls for there to be two deflections, one deflection working opposite the other. These two deflections can be made as arc-shaped guides. Here it is possible for the two deflections to be lined up in succession in an S shape or there can be a flat transport path between the two deflections.

One alternative embodiment calls for there to be several deflections, at least two deflections deflecting in the first direction and at least two deflecting in the opposite direction. This configuration has the advantage that less dramatic deflections are necessary. This is advantageous especially for flexible materials such as cardboard. But a similar effect is also achieved by the arc-shaped guides having a correspondingly large radius.

One possible embodiment calls for the transport path section assigned to the offset generating device to have a flat surface which lies between the deflections and which runs at an angle $\beta$ of 90° to the other transport path sections. In this embodiment the greatest offset is produced by adjustment by an angle $\alpha$ to the transport direction. Here the amount of offset is dependent not only on the angle $\alpha$, but also on the distance h of the plane of the feeding transport path section to the plane of the discharging transport path section. The offset which can be produced is likewise increased by enlarging the indicated surface which extends perpendicularly vertical.

Another embodiment calls for the transport path section assigned to the offset generating device to have a surface which lies between the deflections and which runs at an angle $\beta$ of less than 90° to the other transport path sections. This embodiment of the transport path of offset generating device as a slanted plane on the one hand leads to the attained offset becoming less, but on the other hand this has the advantage that the deflections take place at an obtuse angle and thus also less flexible material can be displaced by the device, as is the case for example for thick paper or cardboard. Here a combination with several deflections or with deflections with large radii is possible.

There are various possibilities for the configuration of the deflections. One proposal calls for the guide of the sheet material to consist of several pairs of rollers, some of the pairs of rollers being made as pairs of guide rollers and some of the pairs of rollers being made as pairs of deflection rollers and at least the latter with respect to their angle to the transport direction can be moved to an angle $\alpha$ which is not equal to 90°. In this embodiment the pairs of rollers must be packed relatively tight and may have only so little angular offset that the material is always securely gripped by the next pair of rollers as it continues to be transported.

Another embodiment calls for the offset generating device to be made with deflections as the guideway with a guide gap between the guide surfaces. It can also be provided here that at the start and at the end of the guideway there is a pair of guide rollers which is used to convey the material by the guideway. These pairs of guide rollers can then be assigned to the offset generating device or the feeding transport path section or the discharging transport path section. The guideway can be sheet metal sections which can be made S shaped, also with a straight section, therefore a surface between the curves. The guideway can of course be composed of all possible materials which have low friction relative to the material to be transported and which can be made with a very smooth surface. For example, the guideway can be made as an aluminum extruded section and can have a special sliding surface of the guide surfaces.

Since there must be guide rollers for transport of the material within the transport path and they may not lie farther apart in their distance than the length of the material, it can be useful to provide at least one pair of guide rollers within the guideway. Feasibly there are so many pairs of guide rollers with a drive in the guideway of the offset generating device that the smallest formats to be processed are still securely grasped. At least one pair of guide rollers is used, but preferably all pairs of guide rollers as pairs of drive rollers are used for delivering sheets of sheet material in the area of the offset generating means. This configuration also allows a large offset for small sheets.

Since the transported sheet material is likewise arranged obliquely due to the slanted position of the offset generating device with respect to the front edge and the rear edge, it is useful if the pairs of guide rollers or the pair of guide rollers is set accordingly. Therefore it is proposed that at least one pair of guide rollers of the offset generating device can be inclined such that the slanted position of the pair of guide rollers corresponds to the slanted position of the front edge of the sheet of the material to be displaced laterally at the site of this at least one pair of guide rollers. This can result in that the front edge of the material is grasped and transported at the same time by two or more rollers and thus an unwanted inclination by failure to grip the front edge of the material at the same time by the pairs of drive rollers or one pair of drums is prevented. This inclination in turn corresponds to the angle $\alpha$ with which the offset generating device is set to produce a certain offset.

One specific embodiment of the inclination of one pair of guide rollers calls for a bearing which carries the pair of guide rollers to be supported in the middle area to be able to swivel on the offset generating device and for a swiveling mechanism for achieving the inclination of the pair of guide rollers to link its swiveling to the swiveling of the offset generating device by the angle $\alpha$. This can lead to the front edge of the material being gripped and transported by two or more rollers at the same time and thus unwanted inclination due to failure to grip the front edge of the material at the same time by the pairs of drive rollers or one pair of drums being prevented. The swiveling mechanism can be made in different ways. One proposal calls for the swiveling mechanism to be a connecting rod which on the one hand is coupled to the bearing of the pair of guide rollers and on the other to a holder which is mounted on the machine housing, the coupling to the bearing being remote from its axis of rotation in order to achieve swiveling of the bearing around the axis of rotation.

Preferably the swiveling mechanism is made such that the respective pair of guide rollers with the inclination is simultaneously displaced laterally such that this offset corresponds to the offset of the material which the latter already has in the area of the pair of guide rollers. This results in that the material is always held and guided on its edge areas. This is used for reliable guidance and careful handling of picture areas when the material is printed. One proposal for a practical version calls for the bearing of the guide rollers to be supported by a swiveling lever which is coupled to the offset generating means.

Feasibly the aforementioned roller pairs are made such that can be set to the width of the material. In this way it is possible to take into account any format width in an optimum manner. Alternatively the rollers can also be made as drums which have the maximum format width, thus it is not necessary to change the setting when the format changes.

Alternatively to the transport of material by rollers or by a guideway, it can also be provided that the device has at least one transport belt. The advantage of these transport belts is that any type of material is reliably guided regardless of its size. Here it is provided that the device has at least one pair of transport belts which interact such that the material can be transported between them. Thus it is possible for the material which is to be displaced to be securely and carefully held and guided since it need not slide on surfaces. Moreover these transport belts can be used for much larger variations with respect to format size since it is irrelevant whether a large or a small format is running through the transport belts.

The transport belts can be made such that one pair of transport belts is used for feed, an angularly adjustable pair of transport belts is used to produce the offset and one pair of transport belts is used for discharge.

In all these approaches, inclining the offset generating device produces an angular gap which must be bridged by the sheet material which is to be transported. Therefore it can often be a good idea for there to be transition guides on the transition from the feeding transport path section to the offset generating device and on the transition from the latter to the discharging transport path section. These transition guides must be made such that they keep up with the angular adjustments in the intended angular range. For example, the transition guide can consist of bars which on one side have a swivel coupling and on the other side a slideway. The latter can be suspended with a swiveling capacity or can be made such that the bars can swivel into it. Of course other configurations are conceivable which keep up with the swiveling motion, for example metal sheets which are fixed on one side and are supported in a slideway on the other.

One especially advantageous embodiment calls for the pair of transport belts to extend over all transport path sections, one pair of rollers at a time being located on the ends of the two transport belts for guiding and driving and in between there being an offset generating device which acts on the pair of transport belts and at least one of the pairs of rollers being made such that it accommodates the resulting offset of the transport belts. This configuration is based on the finding that one such transport belt behaves exactly like a sheet guided by one such offset generating device and likewise has an offset which is dependent on the angular position of the offset generating means. Since the pair of transport belts thus has the same offset as the offset of the material on one side, i.e. the side on which the material leaves the device for generating the offset, the pair of rollers there must be made to accommodate the offset. Either the roller pair has a correspondingly greater width than the transport belt or it is a pair of rollers which can be moved on one axis. For example, they can be rubber rollers which have high friction relative to the transport belt, the rubber rollers being guided on axles and being made such that they can be pushed with little force, therefore have a bearing which can be pushed on the axes with little force. These pairs of rollers then adjust themselves according to the adjusted offset with respect to their lateral position.

In this embodiment there are also various possibilities for impressing the desired offset onto the transport belts by means of the offset generating means. One embodiment calls for the offset generating device to consist of at least two guide surfaces which impress deflections on the transport belts. In this embodiment there is friction between the transport belts and the guide surfaces, but the friction can be kept correspondingly low by a corresponding configuration and material choice of the guide surfaces and the transport belts and it is possible to provide the guide surfaces with relatively gentle deflections, therefore with large radii, and thus to achieve careful directional deflection of the transport belts and also of the materials.

Another embodiment of the offset generating device which acts on the pairs of transport belts consists in at least two rotary elements which are arranged such that they impress at least two deflections on the transport belts. The advantage of this embodiment is that the rotary elements have only very little or no friction against the transport belts and that therefore wear is kept low. There can be two or more rotary elements. Here it is possible to provide two relatively large deflection rollers, one for each deflection. In this way more careful deflection of the materials is achieved. Alternatively there can also be several smaller drums which undertake the deflections in two or more stages which thus take place at several flat angles.

The transport belts can also be made differently; they can be several belts guided in parallel or it is possible to use one wide flat belt per transport belt.

BRIEF DESCRIPTION OF THE DRAWINGS

The invention is explained below using the drawings and embodiments.

DETAILED DESCRIPTION OF THE INVENTION

Figure 1A:
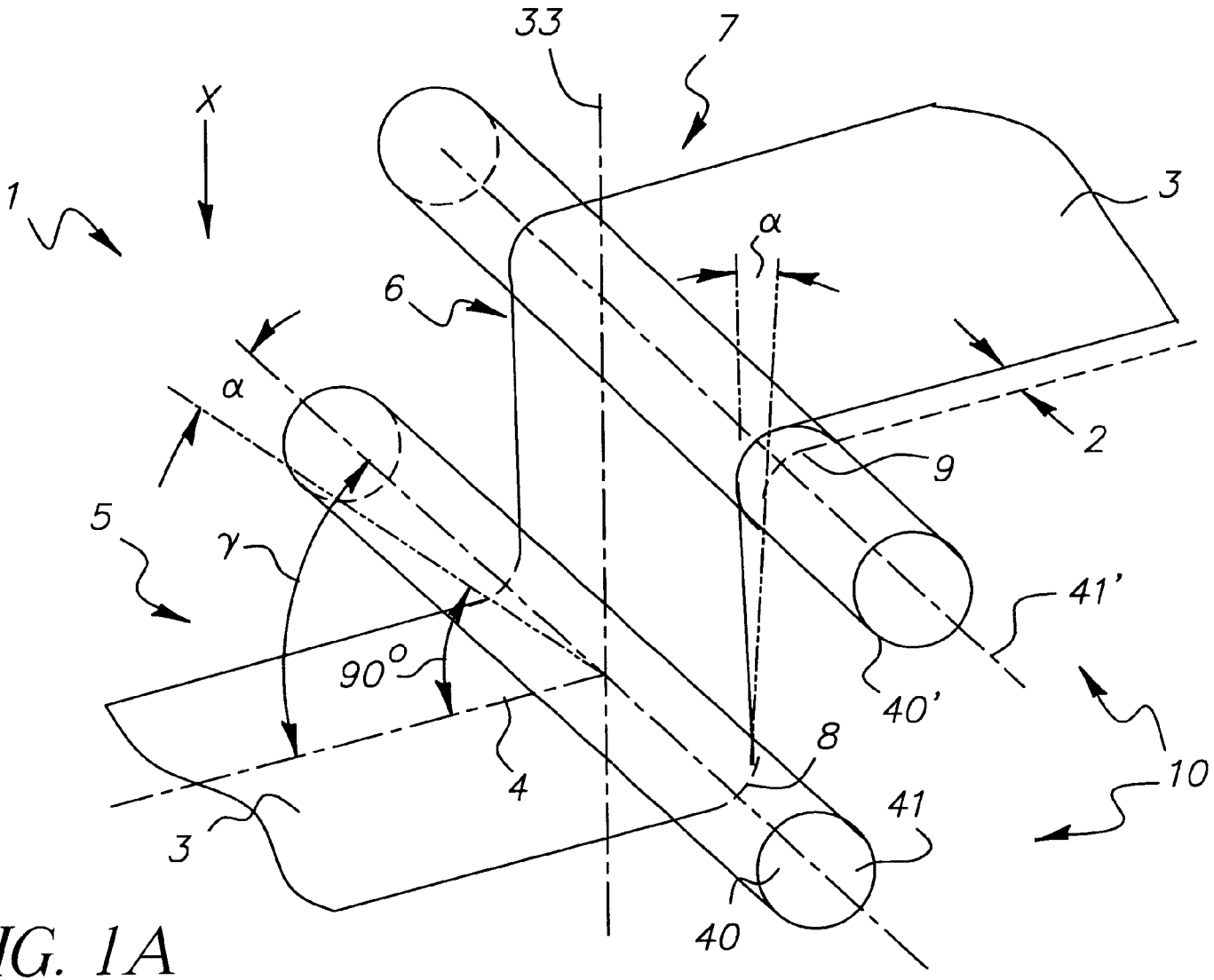
FIG. 1A shows a representation of the principle underlying the invention.

FIG. 1A shows a representation of the principle underlying the invention. This principle consists in that in a device 1 for producing an offset 2 for flexible sheet material the material 3 is delivered and removed on different planes and the flexible sheet material 3 is supplied in between by means of a first deflection 8 and a deflection 9 of the other plane which works in the opposite direction. These deflections 8 and 9 as claimed in the invention are swiveled by an angle $\alpha$ in the horizontal direction such that they assume an angle $\gamma$ which is not equal to 90° to the transport direction. This results in that the material 3, when it is deflected by the feeding transport path section 5 to the transport path section 6 for offset generation 10, is conveyed not vertically, but obliquely to the top such that the outside edges of the material 3 likewise deviate by an angle $\alpha$ from the vertical. In this way, depending on the height of the transport path section 6, an offset 2 is achieved after the material 3 has reached the discharging transport path section 7 following the deflection 9 which works in the opposite direction.

In this example the axes 41 and 41' of the deflection roller 40 and the deflection roller 40' which works in the opposite direction are supported on the offset generating device 10 which can be swiveled around an axle 33 by the angle $\alpha$. The offset generating device 10 can be swiveled by the angle $\alpha$ as shown or in the other direction to achieve an offset 2 to the other side. In the embodiment in FIG. 1A the flexible sheet material 3 is shown as a continuous strip. This is one application of the invention which is not possible in the intermittently operating offset generating device of the prior art. But, in general, individual sheets are deflected in the indicated manner. For this purpose the invention calls for a series of embodiments which will be detailed below. It is common to these embodiments that they have means which reliably guide individual sheets on the indicated transport path sections 5, 6 and 7 by the sheets always being held and transported on both sides by at least one pair of guide elements 13, 13', 13", 14, 14', 17, 17', 18, 18', 19, 19', 20, 20'.

Figure 1B:
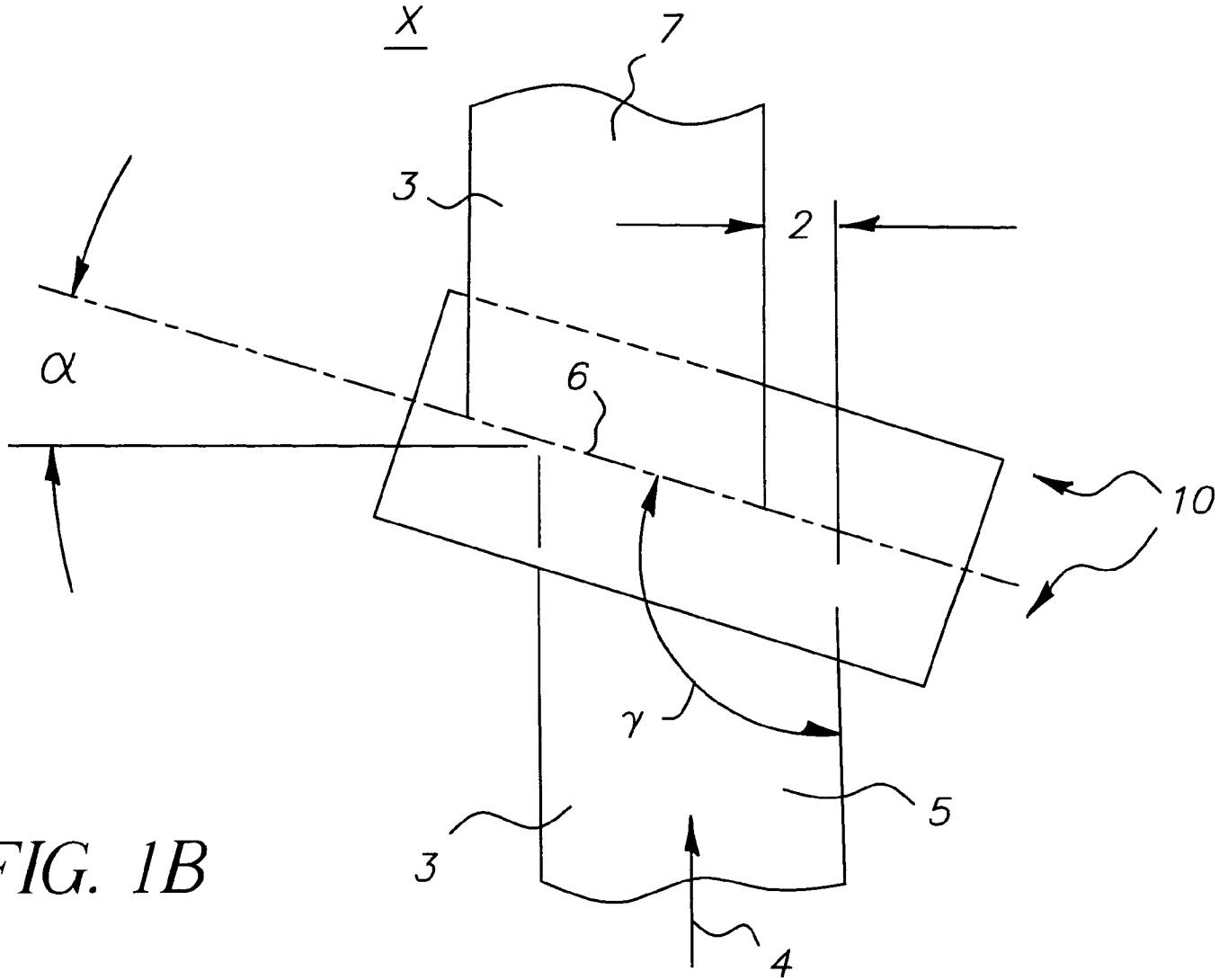
FIG. 1B shows a plan view of FIG. 1A.
Figure 2:
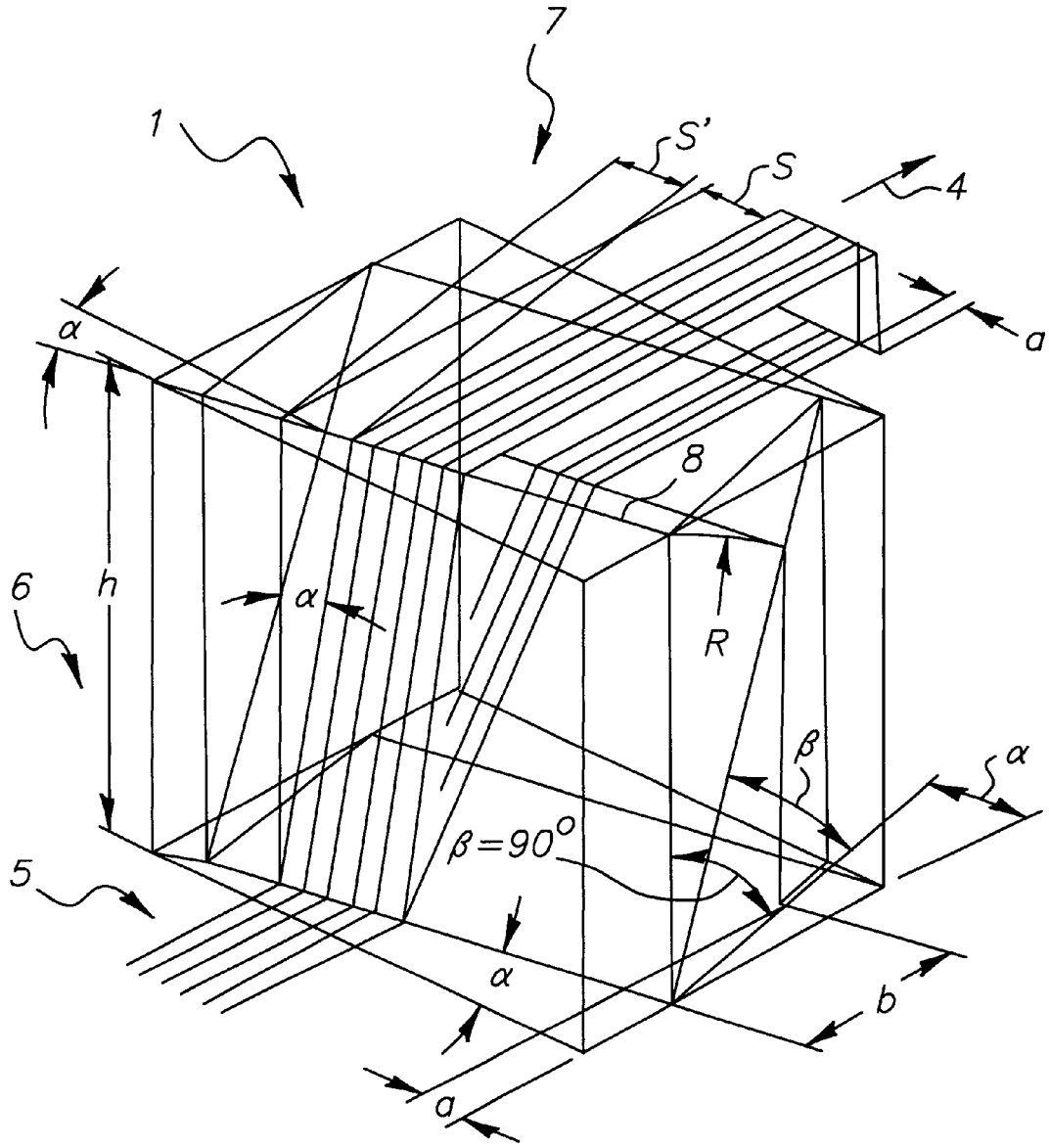
FIG. 2 shows a representation for computing the offset achieved by the invention.

FIG. 1B shows a plan view of the device from FIG. 1A, the offset generating device 10 being shown schematically and the attainable offset being illustrated again by the rotation of the offset generating device 10 by the angle $\alpha$. FIG. 2 shows one representation for computing the offset 2 which can be attained by the invention and which is designated s here or is computed as $s_{total}=s-a$.

First, for the embodiment as shown in FIG. 1A the offset 2, therefore s, is computed as follows: The offset on the upper deflection 8 is s' and is computed from the height h and the angle $\alpha$ as $s'=\tan\alpha\times h$. Since s' runs obliquely to the transport direction 4 by the angle $\alpha$, the ratio of s to s' is computed as $s=s'\times\cos\alpha$. Thus the offset 2 is $s=\tan\alpha\times\cos\alpha\times h$. This applies to the embodiment in FIG. 1A, therefore to the case in which the angle $\beta=90°$ with respect to FIG. 2.

If the transport path section 6 for offset generation is tilted at an angle $\beta$, the offset 2 decreases to $s_{total}=s-a$. To do this, a must be computed. The angle $\beta$ is included in this computation. First a is computed as $a=\sin\alpha\times b$, b being the amount by which the deflection 8 in the horizontal direction is set back relative to the deflection 9; b in turn is computed as $b=\cos\beta\times h$, so that for a the result is:

$a=\sin\alpha\times\cos\beta\times h$. Thus the offset 2 is $s_{total}h\times(\tan\alpha\times\cos\alpha-\sin\alpha\times\cos\beta)$.

Figure 3:
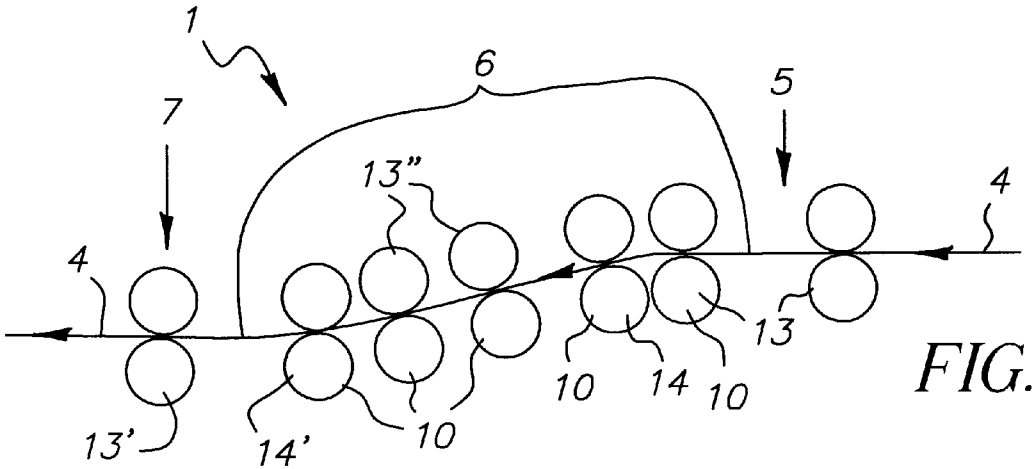
FIG. 3 shows a schematic of one embodiment with rollers.

FIG. 3 shows a schematic of one embodiment with rollers. In this embodiment the material 3 is transported by a plurality of rollers in the transport direction. Thus, two pairs 13 of rollers are assigned to the feeding transport path section 5 and feed the material 3 to a pair 14 of deflection rollers. One of the pairs 13 of rollers, the pair 14 of deflection rollers, the pairs 13' of guide rollers and the pair 14' of deflection rollers which work in the opposite direction are a component of the offset generating device 10 which can be inclined by the above described angle α. It is thus the transport path section 6 which is formed by the offset generating device 10. When this inclination by the angle α has been completed, the material 3, after it leaves the pair 14' of deflection rollers which is working in the opposite direction, has the offset 2. Thus it continues to be conveyed on the discharging transport path section 7 displaced by the offset 2 relative to the feeding transport path section 5 and is optionally deposited with an offset 2 which is different for each job by the angle α being set accordingly.

Figure 4:
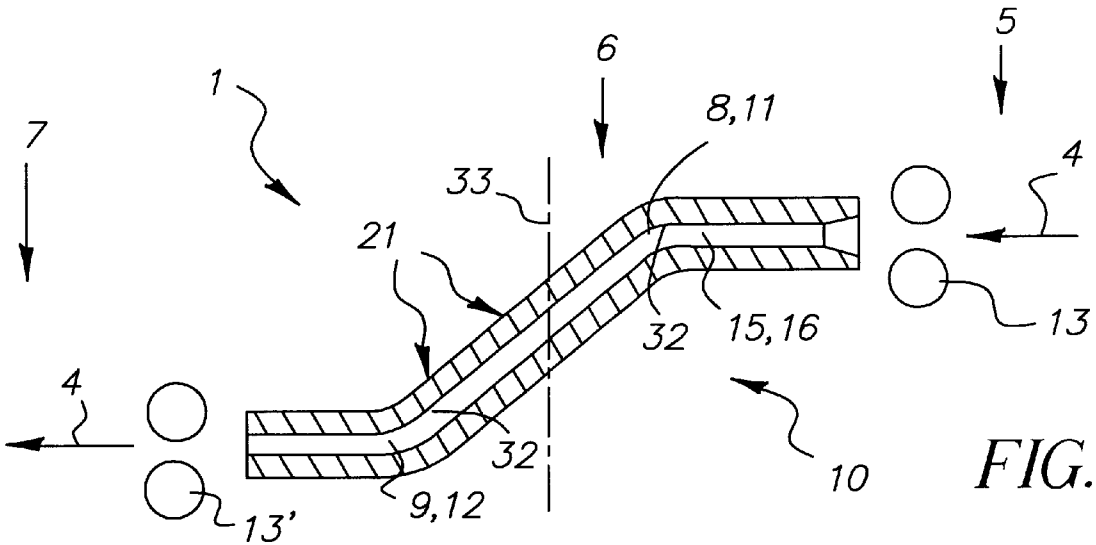
FIG. 4 shows a schematic of one embodiment with a guideway.

FIG. 4 shows a schematic of one embodiment with a guideway 15. Here the rollers 13 and 13' can also be assigned to the transport path section 6 or the feeding transport path section 5 and the discharging transport path section 7. The offset generating device 10 is equipped with a guideway 15 which produces the offset 2. This guideway 15 has deflections 8 and 9 which are made as an arc-shaped guide 11 and an arc-shaped guide 12 which work in the opposite directions. The guideway 15 is formed by a guide gap 16 with guide surfaces 32 which have low friction to the material 3. In this embodiment the offset generating device 10 which is made as a guideway 15 can be inclined by the angle α by its being swiveled around the axis 33. Here the pairs 13 and 13' of rollers must be assigned either to the offset generating device 10 and must be swiveled with it or the distances of the ends of the guideways to the pairs 13 and '13' of rollers must be so large that this swiveling is possible. Optionally there can be transition guides 35 which will be described below. Of course the pairs 13, 13' of guide rollers can be assigned both to the offset generating device 10 and can also be located upstream or downstream of it. Since in this embodiment the distance from one pair 13 of guide rollers to the next pair 13' of guide rollers may not be greater than the length of one sheet of material 3, FIG. 5 proposes one development.

Figure 5:
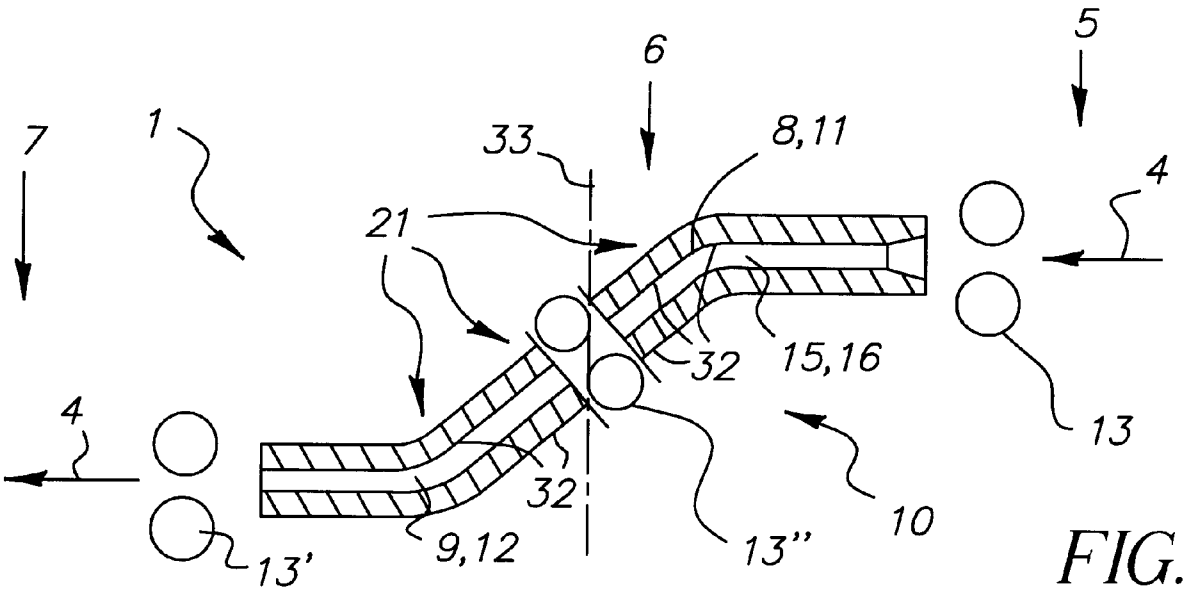
FIG. 5 shows a development of the embodiment as shown in FIG. 4.

FIG. 5 shows the embodiment from FIG. 4, which in addition is equipped with a pair 13" of guide rollers in the plane 21 of the transport path section 6 of the offset generating device 10. Of course several pairs 13" of guide rollers are possible. Here the distance from one pair 13, 13', 13" of guide rollers to the other must be such that it is not greater than the length of one sheet of material 3 so that it is always guided by at least one, but preferably two pairs 13, 13', 13" of guide rollers. Of course, in this and also the other embodiments the transport direction 4 can also run in the opposite direction.

Since sheets of the sheet material 3 in the area of the transport path section 6 of the offset generating device 10 are transported inclined, therefore the front edge 22 of the sheet is inclined by the angle α, the problem of guidance by horizontally arranged pairs 13" of guide rollers in the plane 21 of the transport path section 6 is that the rollers 13" do not grip the front edge 22 of the sheet at the same time and therefore an unintentional change in the position of the material 3 can occur. Therefore it is a good idea to configure the pairs 13" of guide rollers such that they are likewise inclined according to the oblique course of the front edge 22 of the sheet. The development shown in FIG. 6 is used for this purpose.

FIG. 6 shows one embodiment of a pair 13" of guide rollers which can be inclined in the plane 21 of the transport path section 6. In this figure the other pairs 13 and 13' of guide rollers and a possible guideway 15 were omitted, of course the pairs of 13 and 13' of guide rollers can likewise be inclined accordingly when they are assigned to the offset generating device 10. The described embodiment of the inclinable pair 13" of guide rollers can be provided in one embodiment as shown in FIG. 5 or FIG. 3. There can be one or more pairs 13" of guide rollers or one or more pairs 13, 13', 13" of guide rollers. Only one pair 13" of guide rollers was shown for the sake of simplification.

In this embodiment a swiveling mechanism 24 is used to swivel the pairs 13" of guide rollers in the plane 21 of the transport path section 6 such that it is parallel to the front edge 22 of the sheet. The swiveling is indicated by the arrows 47. It runs simultaneously with the same angle α by which the offset generating device 10 is also swiveled. The latter is shown by the arrows 46. This swiveling takes place by the axis 33 and can be effected by means of a swiveling drive 40.

So that the pair 13" of guide rollers swivels by the same angle α, it is located on a bearing 30 which is connected to the swiveling lever 50. The swiveling lever 50 is mounted on the offset generating device 10 in the area of its axis 33 to be able to swivel around an axis 29 of rotation by means of a coupling 52. The swiveling lever 50 causes a lateral deflection of the pair 13" of guide rollers which is matched to the offset of the material 2 in the area of the pair 13" of guide rollers. The axis 29 of rotation runs essentially perpendicular to the surface 21. So that the bearing 30 of the pair 13' of guide rollers executes swiveling which is simultaneous with the offset generating device 10, on the machine housing 26 there is a holder 27 on which the coupling 31 of a connecting rod 25 is located which is connected on its other end by a coupling 28 to the bearing 30. Here both the distance of the coupling 28 from the axis 29 of rotation and also an off-centered coupling 28 with respect to the bearing 30 is necessary to move the bearing 30, which movement contains both the desired angular position α and also the required offset. To do this the length of the swiveling lever 50, the length of the connecting rod 25 and the arrangement of its couplings 31 and 28 must be dimensioned or arranged accordingly. These amounts can be computed or empirically determined by one skilled in the art. In order to ensure exact positioning of the pair 13' of guide rollers it is provided that the bearing 30 is guided on its ends by means of guides 48 which are connected to the offset generating device 10. These guides 48 must be made such that they also allow lateral offset.

To achieve clean transport of sheets of a material 3, it is furthermore provided that between the offset generating device 10, the feeding transport path section 5 and the discharging transport path section 7 there are transition guides 35. They can be for example several rods 36.

Figure 6A:
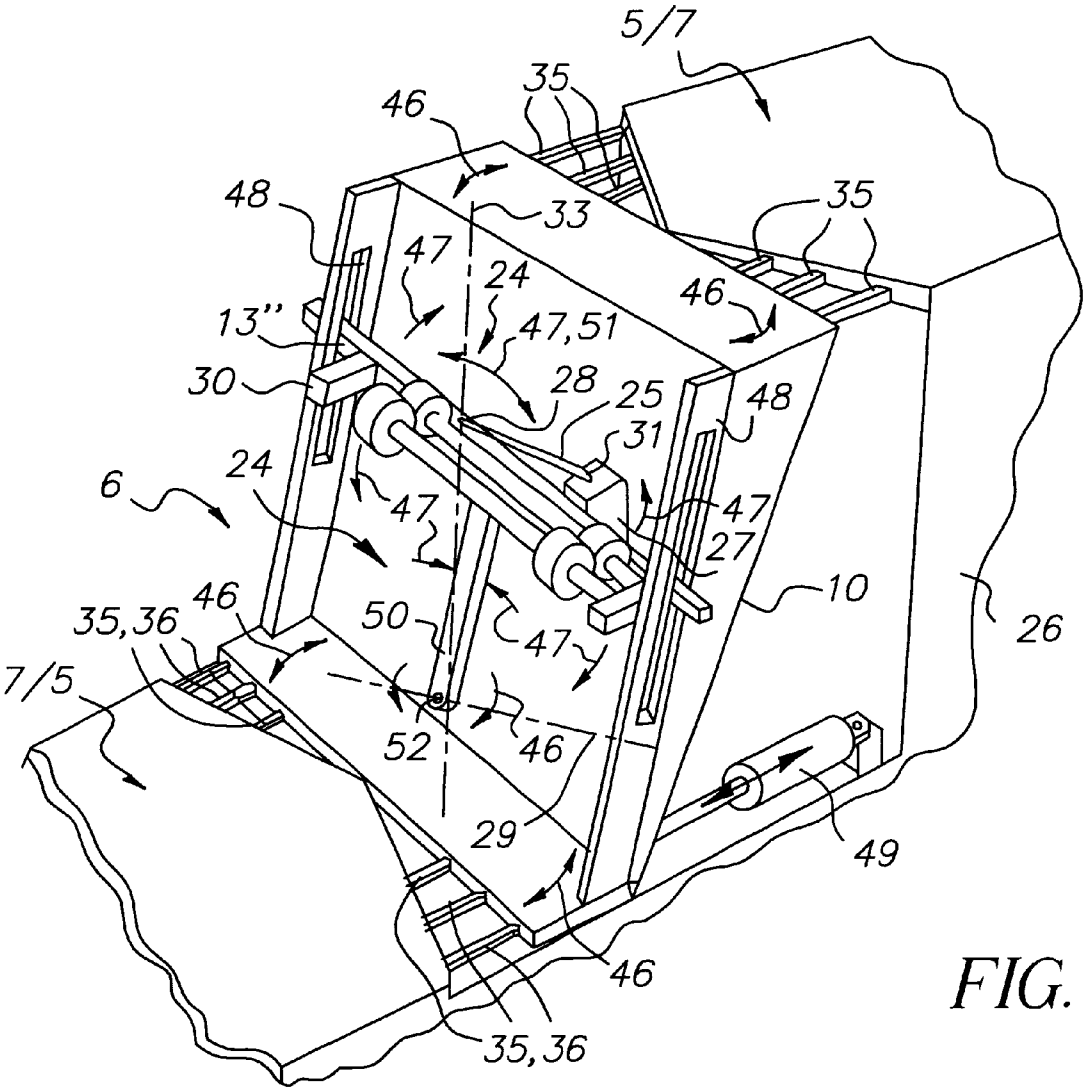
FIG. 6A shows one embodiment of an adjustable pair of guide rollers and transition guides.
Figure 6B:
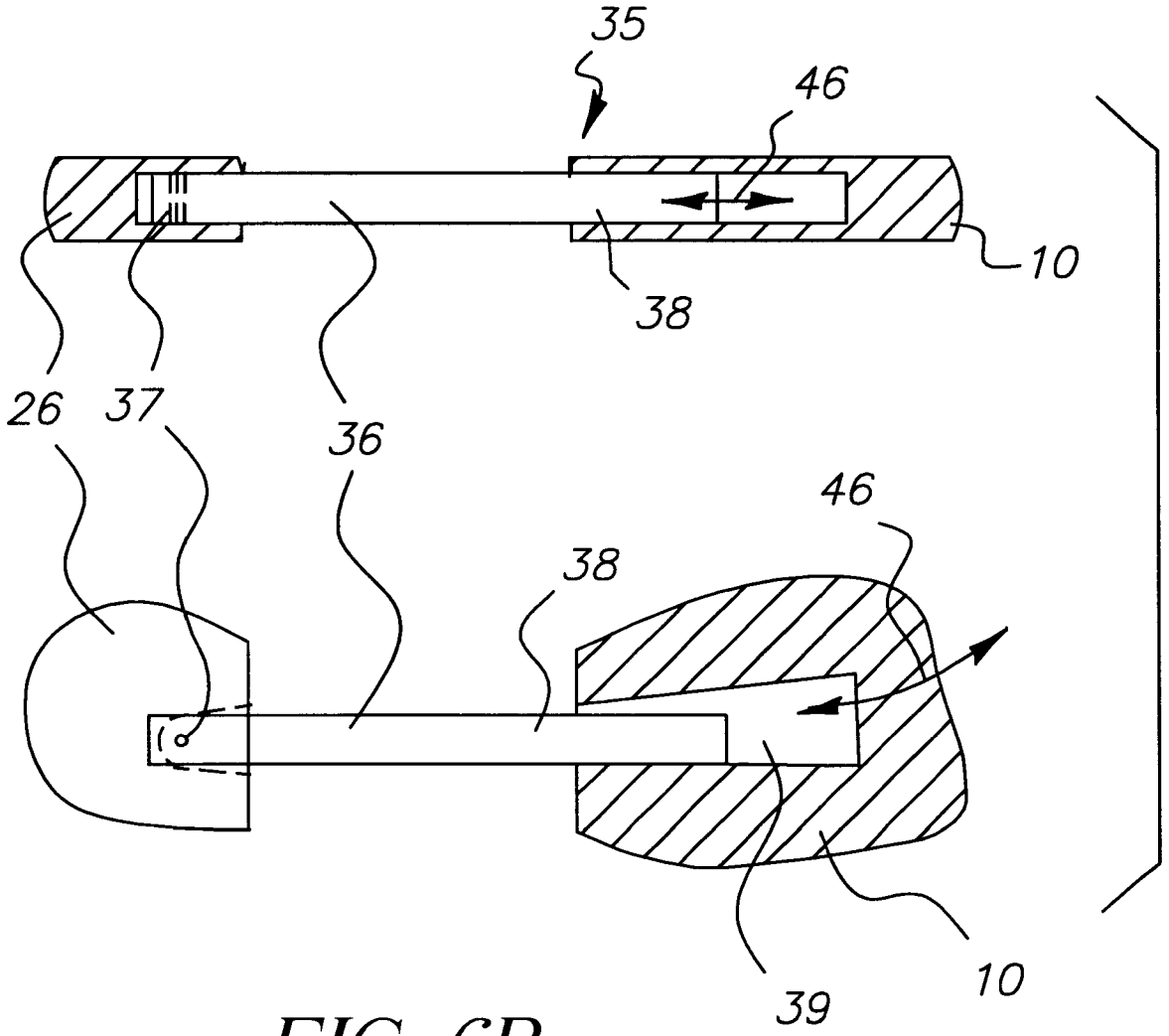
FIG. 6B shows a detail of FIG. 6A.

FIG. 6B shows one possible embodiment of these transition guides 35. The upper representation shows a side view in a section, the lower one a plan view, the slideway 38 being cut away. The rods 36 are supported on one side by means of a swiveling coupling 37 and on the other end by means of a slideway 38. The latter must be made such that it takes into account the swiveling of the offset generating device 10 in the direction of the double arrow 46 (FIG. 6A).

Figure 7:
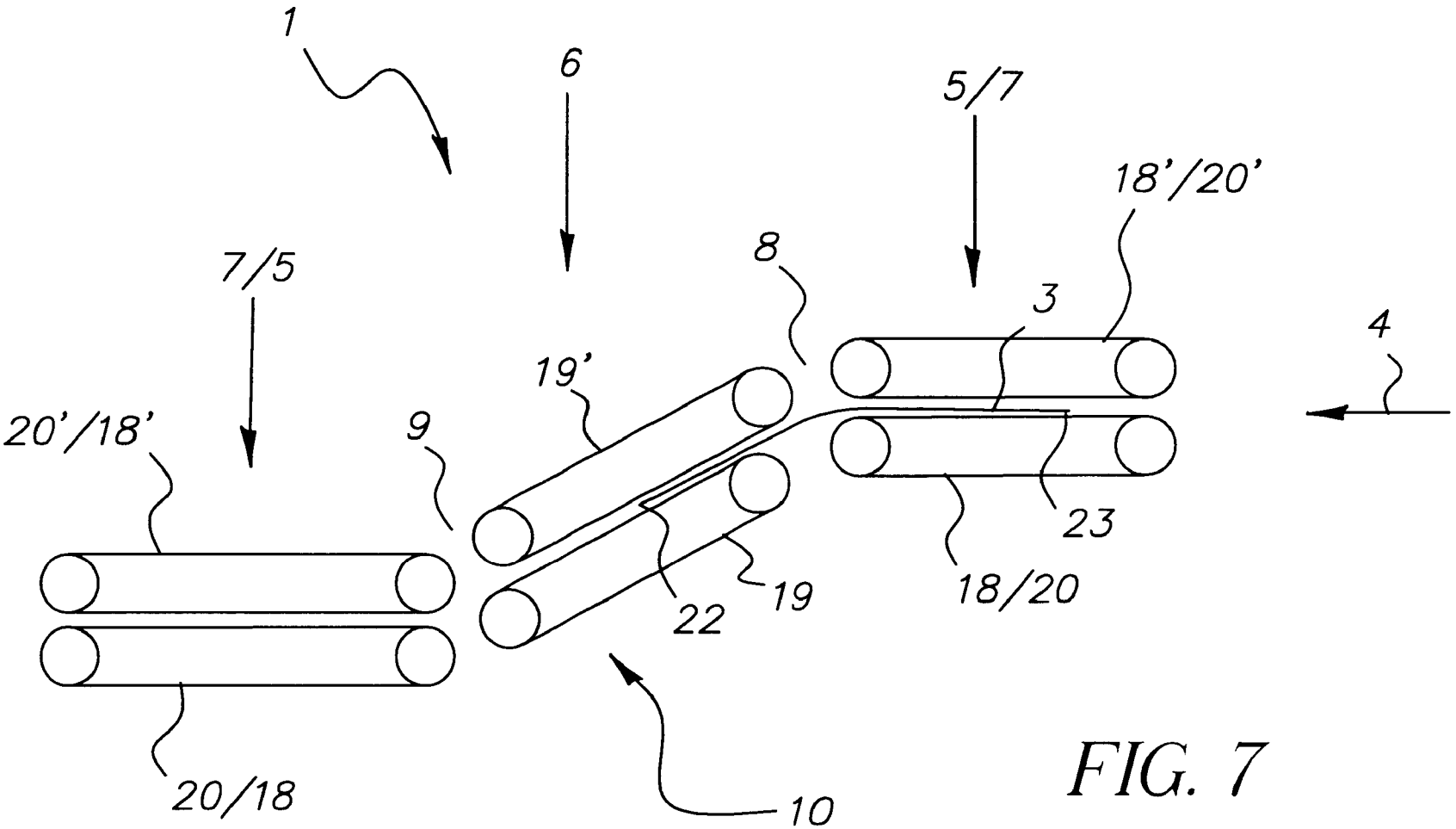
FIG. 7 shows the principle of one embodiment with transport belts.

FIG. 7 shows the principle of one embodiment with transport belts. In this embodiment a pair of transport belts 18, 18' are assigned to the feeding transport path section 5, another pair of transport belts 19, 19' is assigned to the transport path section 6 of the offset generating device 10 and a third pair of transport belts 20, 20' is assigned to the discharging transport path section 7. This sequence applies to the transport direction in the direction of the arrow 4, the front edge 22 of the sheet being transported from right to left. Reference numbers with primes designate an arrangement which applies to the reverse direction of transport. This means that the rear edge 23 of the sheet then becomes the front edge 22 of the sheet and the transport direction 4 turns.

In this embodiment, deflections 8 and 9 take place in the transfer from one pair of transport belts to the other, thus from the pair 18, 18' of transport belts to the pair 19, 19' of transport belts, and from the latter to the pair 20, 20' of transport belts. It is thus necessary on the one hand for there to be enough space to incline the transport belts 19 and 19', on the other hand this space should not be too large so that the front edge 22 of the sheet is reliably transferred from one belt to the other. Therefore a transition guide can be inserted similarly to as described above. It is also possible to avoid this transfer by there being only one pair 17, 17' of transport belts. This is the subject matter of the following embodiments.

Figure 8:
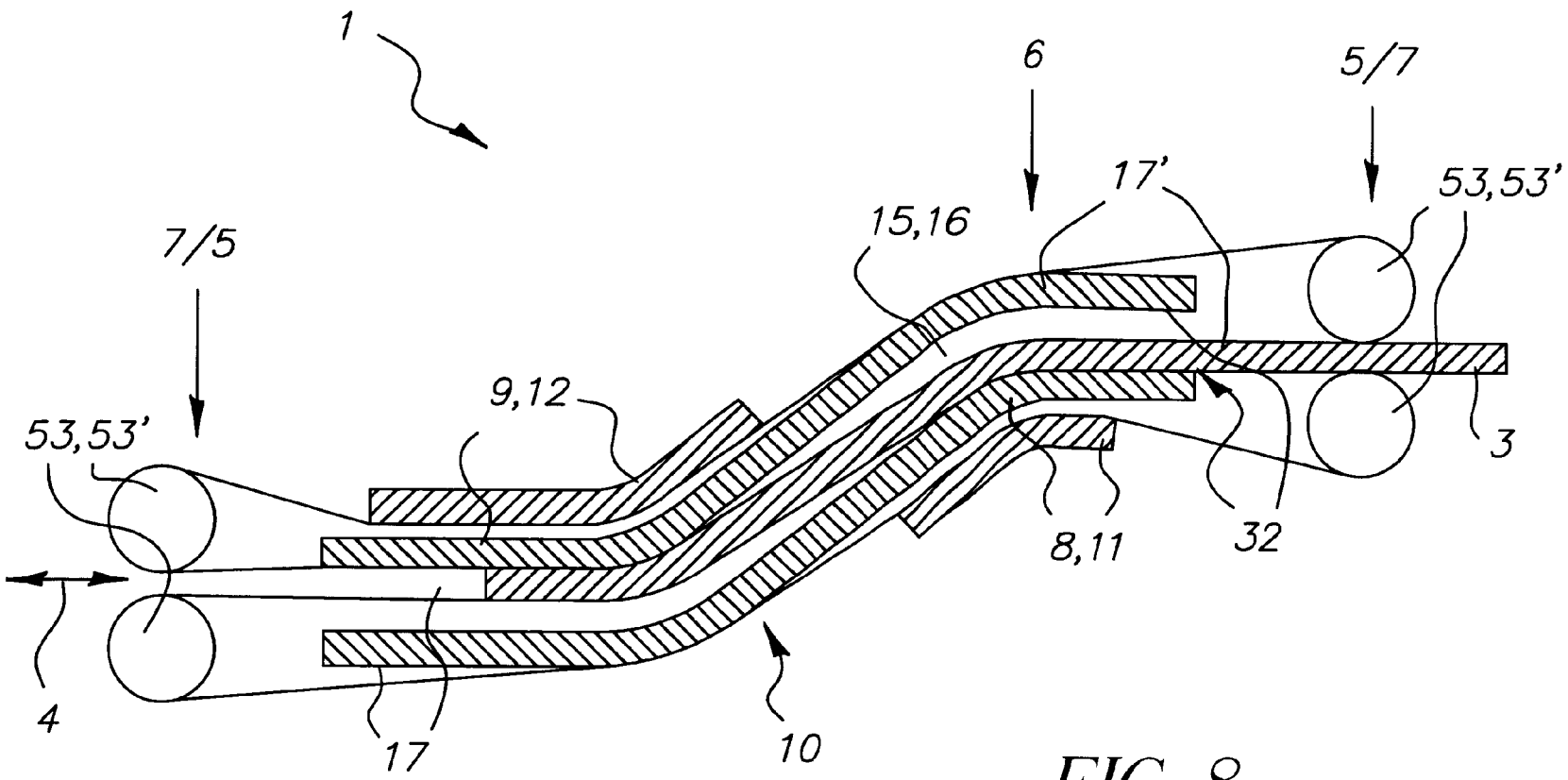
FIG. 8 shows one embodiment with a transport belt and arc-shaped guides.
Figure 9:
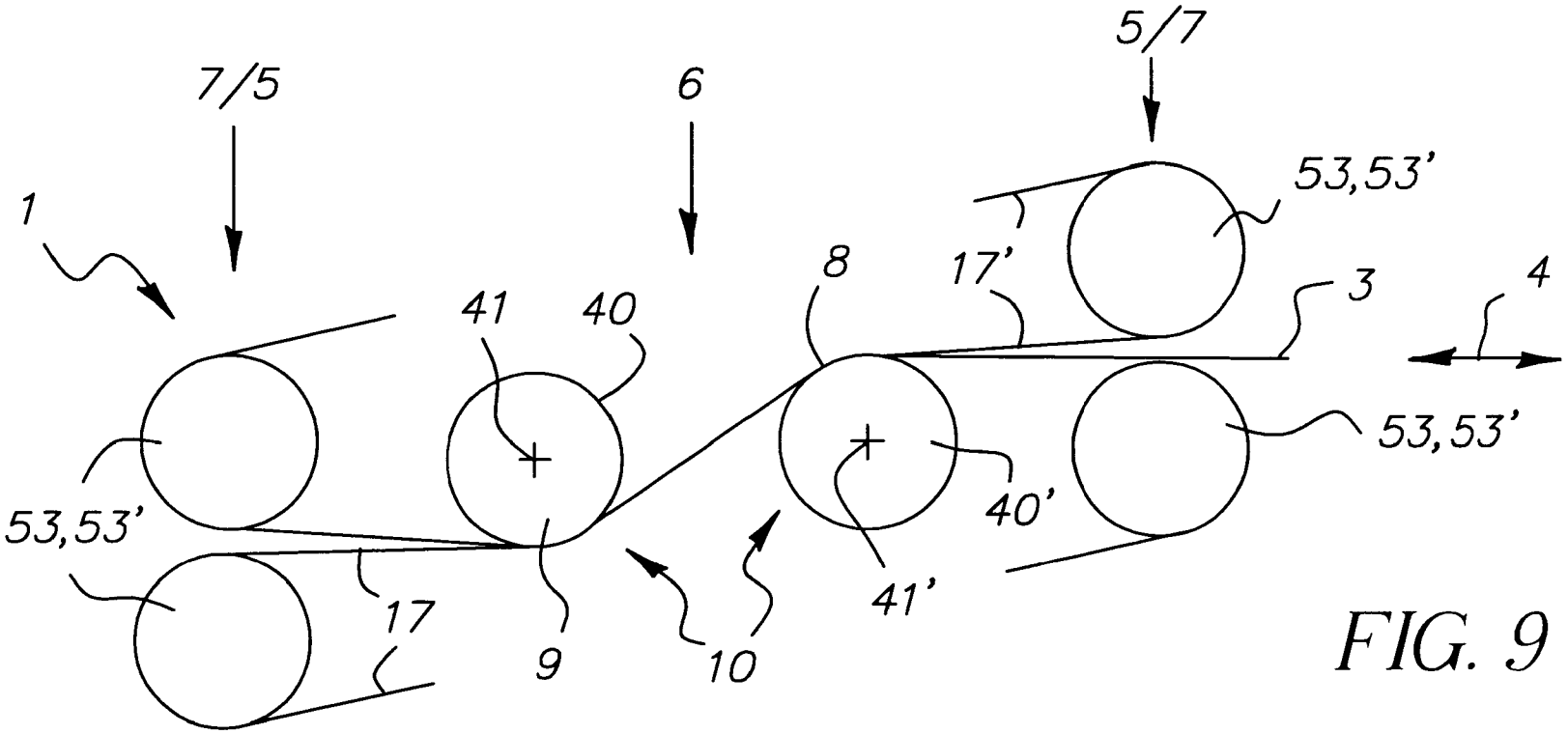
FIG. 9 shows one embodiment with a transport belt and rollers.

FIG. 8 shows one embodiment with a single pair 17, 17' of transport belts. Deflections 8, 9 take place by means of arc-shaped guides 11, 12. The roller pairs 53, 53' guide and drive the top transport belt 17' and the bottom transport belt 17. They are supported to be unable to swivel in the machine housing 26. The offset generating device 10 consist of a guide which has a deflection 8 which is made as an arc-shaped guide 11 and an arc-shaped guide 12 which works in the opposite direction as the deflection 9. The return strand of the transport belts 17, 17' are likewise deflected so that the opposite offset returns to the initial position. This guideway 15 with the arc-shaped guides 11, 12 can be inclined horizontally at an angle $\alpha$, its producing an offset 2 of the transport belts 17 and 17' in the manner already shown in FIG. 1. If a sheet of material 3 is being transported between the transport belts 17 and 17', it likewise undergoes the offset 2 of the transport belts 17 and 17'. Since the transport belts 17 and 17' rub against the guide surfaces 32 of the arc-shaped guides 11 and 12, the guide surfaces 32 should be equipped with a very good, for example, polished surface. The advantage of guidance by means of a pair 17, 17' of transport belts is that the material 3 is securely held and transported between these transport belts 17 and 17' regardless of the format size. Elements which are used to feed and remove the material 3 were omitted in the representation. To prevent friction between the transport belts 17, 17' and the offset generating device 10 the following alterative embodiments are used:

FIG. 9 shows an embodiment similar to FIG. 8 in which however the arc-shaped guides 11 and 12 are replaced by deflection rollers 40 and 40'. Here one of the deflection rollers runs in the opposite direction to the other. In this embodiment one deflection 8 is achieved by the deflection roller 40' and the other deflection 9 by the deflection roller 40. An offset 2 is produced here by the axes 41 and 41' of the deflection rollers 40 and 40' being inclined by the angle $\alpha$, as was already explained for FIG. 1A. Here a transport direction 4 is also possible in both directions, the material 3 likewise being reliably transported, as described for FIG. 8, without in doing so friction occurring between the transport belts 17 and 17' and the guide surface. The deflection 8 and 9 which is easy on the material 3 is achieved by the corresponding size of the deflection rollers 40, 41'. Here too the opposite offset of the return strand of the transport belts 17 and 17' must be produced. This is not shown, for the sake of simplification, but can likewise take place by means of deflection rollers.

Figure 10B:
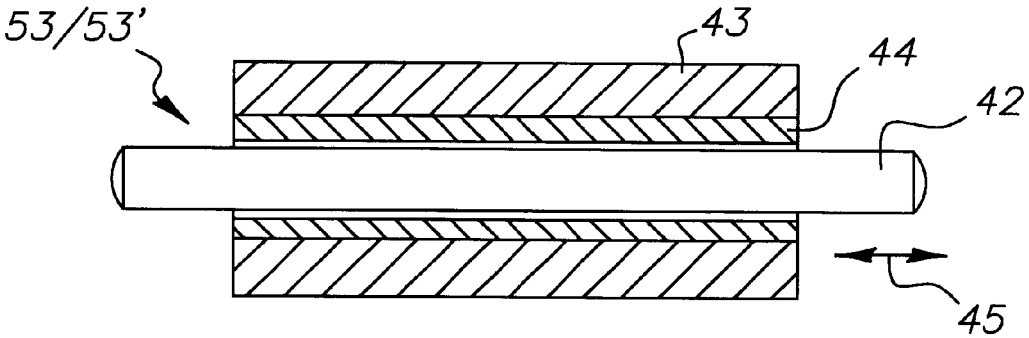
FIG. 10B shows a detail from FIG. 10A.
Figure 10A:
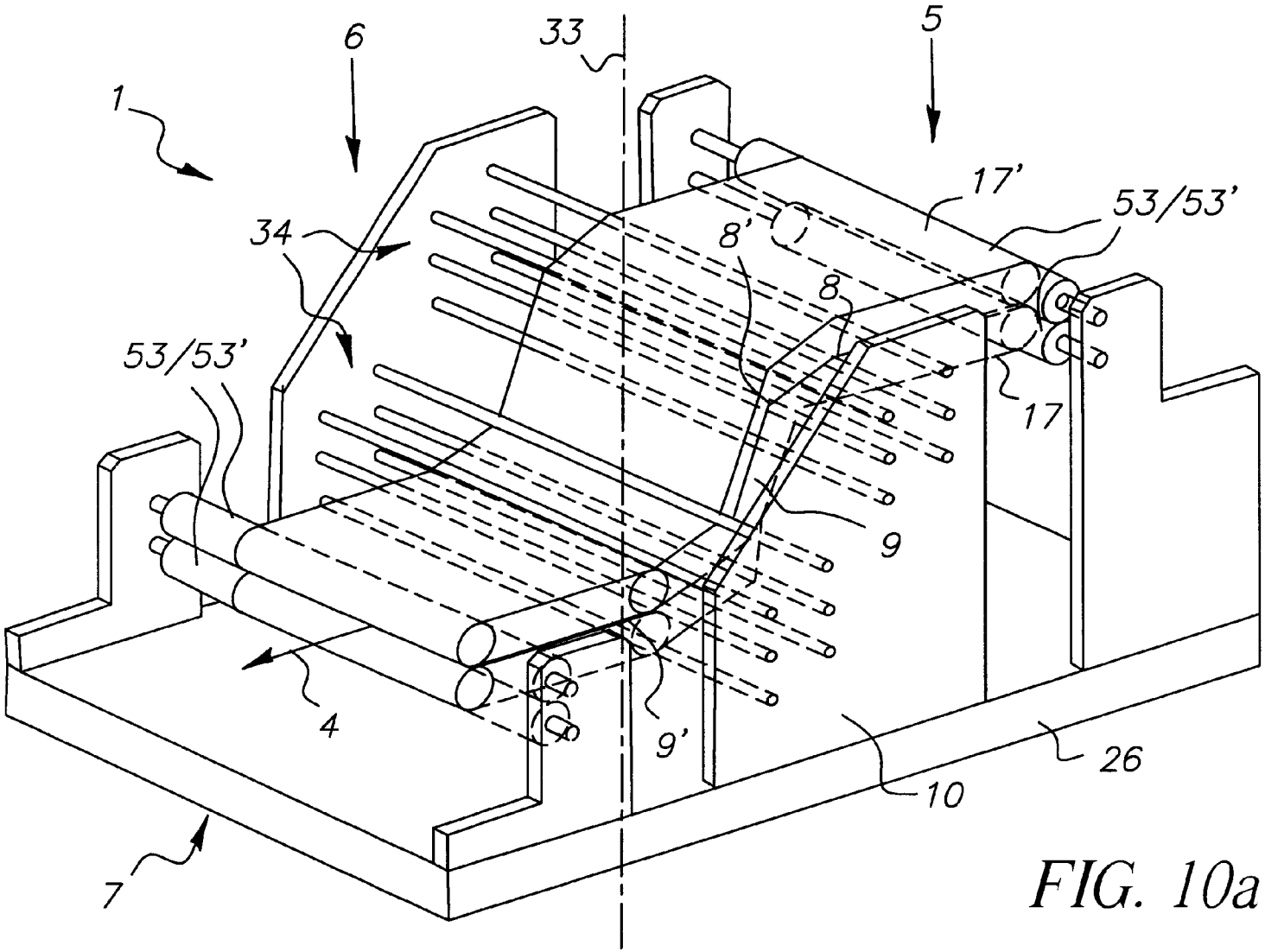
FIG. 10A shows a perspective of another embodiment with a transport belt and a host of rotary drums.
Figure 11A:
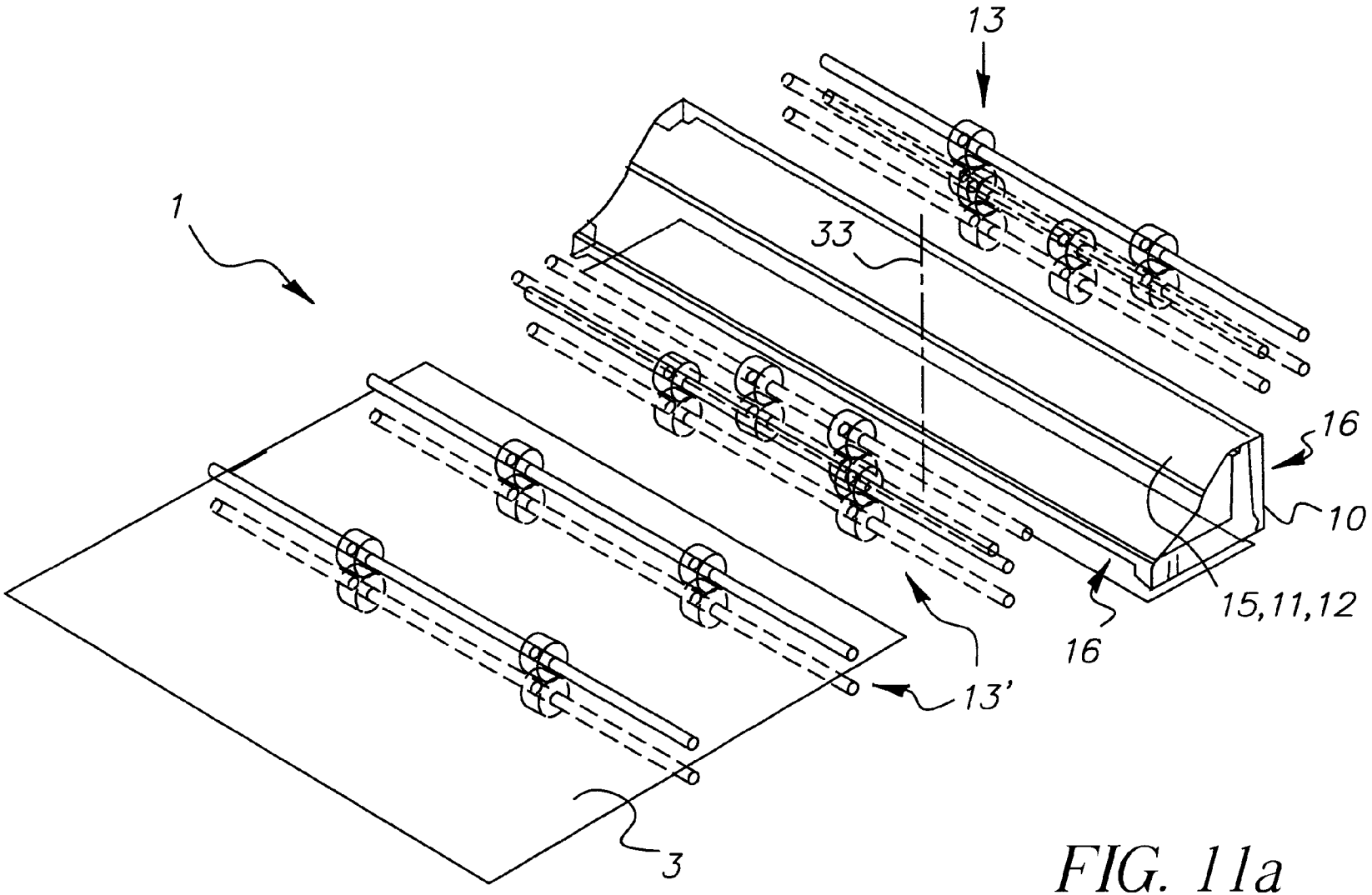
FIG. 11*a* and FIG. 11*b* show a perspective of one embodiment with arc-shaped guides and guide means as shown in FIG. 8.
Figure 11B:
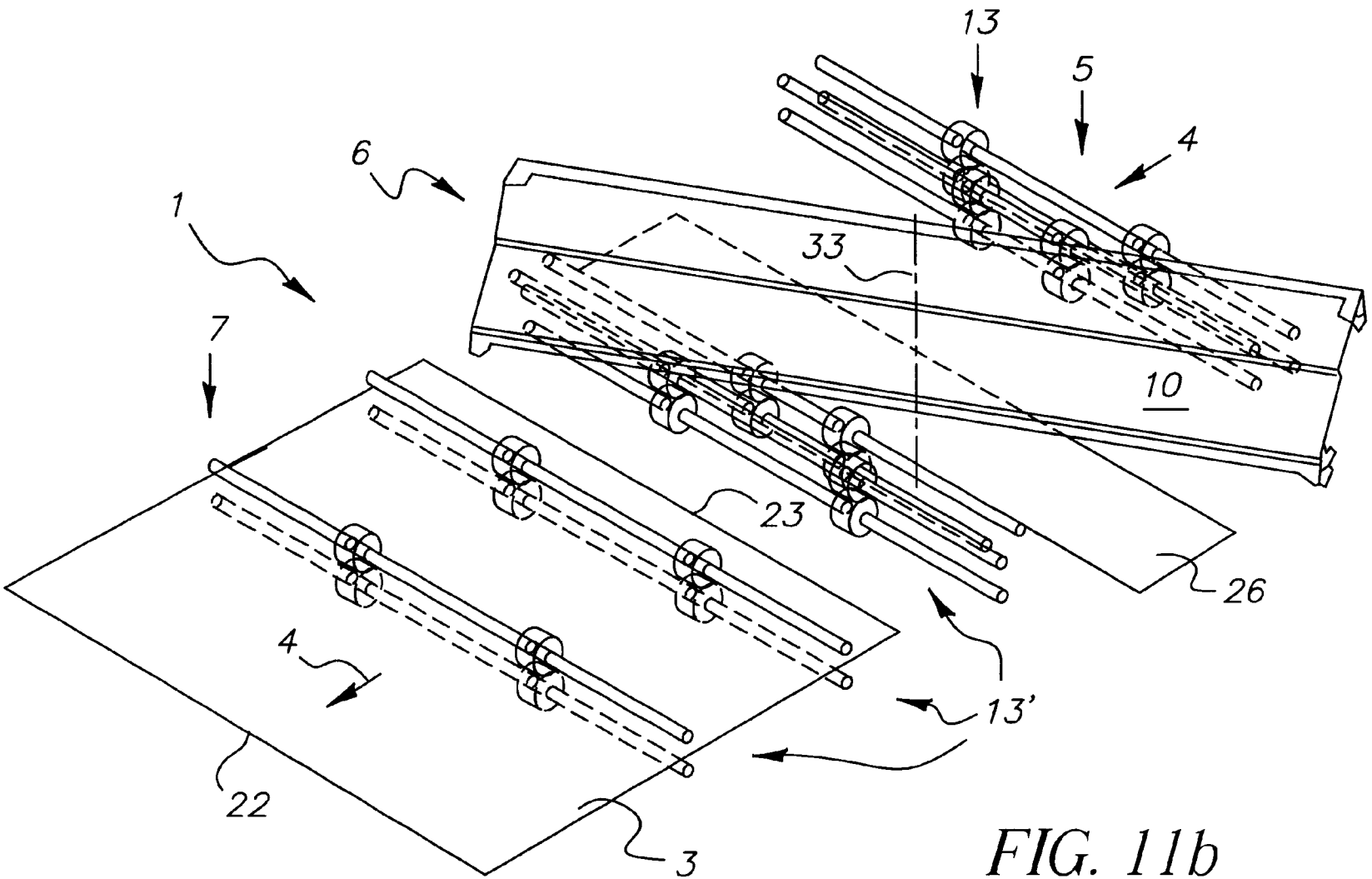

FIG. 10 shows a perspective representation of one embodiment which functions according to the principle described for FIG. 9. The difference is that instead of the deflection rollers 40 and 40' there are several drums 34. These drums 34 are arranged such that they form two deflections 8 and 8' in one direction and two deflections 9 and 9' which work in the opposite direction. Furthermore, the drums 34 are also used to return the transport belts 17 and 17'. In this embodiment all the drums 34 are located on the offset generating device 10 which can likewise be swiveled around an axis 33. In the figure this swiveling does not take place; if this is done the transport belts 17 and 17' drift to one aside, for which it is necessary that the roller pairs 53 or 53' which are supported in the housing on this side accommodate the offset 2 of the transport belts 17 or 17'. For this purpose these roller pairs 53 or 53' must be correspondingly wide or have the configuration which is shown in FIG. 10B.

FIG. 10B shows one roller of a roller pair 53 or 53' which is made as a rubber roller 43 with a slide bearing 44. It runs on a shaft 42 and can be shifted on it in the direction of the double arrow 45. In this way one roller pair 53 or 53' is shifted by the offset 2 as soon as it is produced by the offset generating device 10 being swiveled around the axis 33 which is supported in the housing 26 by the angle $\alpha$.

The invention has been described in detail with particular reference to certain preferred embodiments thereof, but it will be understood that variations and modifications can be effected within the spirit and scope of the invention.

PARTS LIST

1 device for producing an offset

2 offset (in the computation s or $s_{tot}$)

3 flexible sheet material

4 arrow: transport direction

5, 6, 7 transport path

5 feeding transport path section

6 transport path section for producing an offset

7 discharging transport path section

8, 8' deflections

9, 9' deflections working in the opposite direction

10 offset generating means

11 arc-shaped guide

12 arc-shaped guide working in the opposite direction

13, 13', 13" guide roller pairs

13 guide roller pair(s) in the plane of transport path section 5

13' guide roller pair(s) in the plane of transport path section 7

13" guide roller pair(s) in the plane of transport path section 6

14 deflection roller pair(s)

14' deflection roller pair(s), working in opposite direction

15 guide path

16 guide gap

17 bottom transport belt

17' top transport belt

18 bottom feeding transport belt

18' top feeding transport belt

19 bottom transport belt of the offset area

19' top transport belt of the offset area

20 bottom discharging transport belt

20' top discharging transport belt

21 surface of the transport belt section of the offset generating means

22 front edge of sheet

23 rear edge of sheet

24 swiveling mechanism

25 connecting rod

26 machine housing

27 holder

28 coupling of the connecting rod to the bearing of the guide roller pair 13"

29 axis of rotation of the bearing of the guide roller pair 13"

30 bearing of the guide roller pair 13"

31 coupling of the connecting rod to the holder

32 guide surfaces

33 axis around which the offset generating means can be swiveled

34 rotary drum

35 transition guides

36 rods

37 swiveling coupling

38 slideway

39 recess

40 deflection roller for the transport belt

40' deflection roller for the transport belt, working in the opposite direction

41 axis of the deflection roller 40

41' axis of the deflection roller 40' working in the opposite direction

42 shaft

43 rubber roller

44 sliding bearing sleeve

45 double arrow: displacement of the rollers 39'

46 double arrows: rotary motion of the offset generating means

47 double arrows: swiveling of the guide roller bearing 30

48 guide of the bearing 30 on the offset generating means

49 swiveling drive

50 swiveling lever for the bearing 30

51 offset of one guide roller pair 13"

52 coupling of the swiveling lever 50

53, 53' roller pairs for transport belts α swiveling angle of the offset generating means β angle of the surface of the offset generating means to the feeding or discharge transport belt section γ angle of the deflections to the transport direction s offset 2 when beta=90°

$s_{tot}$ offset 2 when beta is not equal to 90° h(=R) vertical difference from the feeding or discharge transport belt section s' offset measured in the line of the deflection a correction to compute the offset 2 when beta is not equal to 90° b horizontal distance of deflections

What is claimed is:

1. Device (1) for generating an offset (2) of transported flexible sheet material (3), especially sheets of paper, with a feeding and a discharging transport path section (5 and 7) and a transport path section (6) which is assigned to the offset generating device (10), characterized in that the offset generating device (10) has at least two deflections (8, 9, or 8, 8', 9, 9') which are parallel, which work in opposite directions, and which can be moved to an angle (γ) to the transport direction (4), and this angle is measured in the plane of the feeding transport path section (5) and is not equal to 90 degrees projected onto this plane.

2. Device as recited in claim 1, wherein the offset generating device (10) is made as a unit which can be swiveled by an angle (α).

3. Device as recited in claim 1, wherein for the offset (2) of sheet material (3) there are pairs of guide elements (13, 13', 13", 14, 14', 17, 17', 18, 18', 19, 19', 20, 20') arranged such that the sheets are always held and transported on both sides by at least one pair (13, 13', 13", 14, 14', 17, 17', 18, 18', 19, 19', 20, 20') of guide elements.

4. Device as recited in claim 3, wherein the feeding and discharging transport path section (5 and 7) lie on parallel planes.

5. Device as recited in claim 3, wherein the transport belts (17, 17', 18, 18', 19, 19', 20, 20') are flat belts.

6. Device as recited in claim 1, wherein there are two deflections (8, 9).

7. Device as recited in claim 6, wherein the two deflections (8, 9) are made as arc-shaped guides (11, 12).

8. Device as recited in claim 7, wherein the two deflections (8, 9) are lined up in a row in an S shape.

9. Device as recited in claim 1, wherein there are transition guides (35) on the transition from the feeding transport path section (5) to the offset generating device (10) and on the transition from the latter to the discharging transport path section (7).

10. Device as recited in claim 9, wherein the transition guides (35) consist of bars which on one side have a swivel coupling (37) and on the other side a slideway (38).

11. Device as recited in claim 1, wherein there are several deflections (8, 8', 9, 9'), at least two (8, 8') deflecting in the first direction and at least two (9, 9') deflecting in the opposite direction.

12. Device as recited in claim 11, wherein the transport path section (6) assigned to the offset generating device (10) has a surface (21) which lies between the deflections (8 and 9 or 8, 8' and 9, 9') and which runs at an angle (β) of 90° to the other transport path sections (5 and 7).

13. Device as recited in claim 11, wherein the transport path section (6) assigned to the offset generating device (10) has a surface (21) which lies between the deflections (8 and 9 or 8, 8' and 9, 9') and which runs at an angle (β) of less than 90° to the other transport path sections (5 and 7).

14. Device as recited in claim 13, wherein the guidance of the sheet material (3) consists of several pairs (13, 13', 13", 14, 14') of rollers, some of the pairs of rollers being made as pairs (13, 13', 13") of guide rollers and some of the pairs of rollers being made as pairs (14, 14') of deflection rollers and at least the latter with respect to their angle to the transport direction (4) can be moved to an angle (γ) which is not equal to 90°.

15. Device as recited in claim 11, wherein the distance of the roller pairs (13, 13', 13", 14, 14') can be adjusted to the width of the material (3).

16. Device as recited in claim 14, wherein said roller pairs (13, 13', 13", 14, 14') are drums which are at least as wide as the maximum width of the material (3).

17. Device as recited in claim 13, wherein the offset generating device (10) is made with deflections (8, 8', 9, 9') as a guideway (15) with a guide gap (16) between the guide surfaces (32).

18. Device as recited in claim 17, wherein at the start and at the end of the guideway (15) there is a pair (13, 13') of guide rollers.

19. Device as recited in claim 18, wherein within the guideway (15) there is at least one pair (13") of guide rollers.

20. Device as recited in claim 19, wherein at least one pair (13, 13', 13") of guide rollers is used as the pair of drive rollers for delivering the sheet material (3) in the area of the offset generating device (10).

21. Device as recited in claim 20, wherein at least one pair of guide rollers (13, 13', 13") of the offset generating device (10) can be inclined such that the slanted position of the pair (13, 13', 13") of guide rollers corresponds to the slanted position of the front edge (22) of the sheet of the material (3) which is to be displaced laterally at the site of this at least one pair (13, 13', 13") of guide rollers.

22. Device as recited in claim 21, wherein a bearing (30) which carries the pair (13, 13', 13") of guide rollers is supported to be able to swivel on the offset generating device (10) and wherein a swiveling mechanism (24) for achieving the inclination of the pair (13, 13', 13") of guide rollers links its swiveling to the swiveling of the offset generating device (10) by the angle $\alpha$.

23. Device as recited in claim 22, wherein the swiveling mechanism (24) is a connecting rod (25) which is coupled to the bearing (30) of the pair (13, 13', 13") of guide rollers and to a holder (27) which is mounted on the machine housing (26), the coupling (28) to the bearing (30) being remote from its axis (29) of rotation to effect swiveling.

24. Device as recited in claim 23, wherein the swiveling mechanism (24) is made such that the respective pair (13, 13', 13") of guide rollers with the inclination is simultaneously displaced laterally such that this offset (51) corresponds to the offset of the material (3) which the latter already has in the area of the pair (13, 13', 13") of guide rollers.

25. Device as recited in claim 24, wherein the bearing (30) of the guide rollers (13, 13', 13") is supported by a swiveling lever (50) which is coupled (52) to the offset generating device (10).

26. Device as recited in claim 1, wherein it has at least one transport belt (17, 17', 18, 18', 19, 19', 20, 20').

27. Device as recited in claim 26, wherein the transport belts (17, 17', 18, 18', 19, 19', 20, 20') are each several belts.

28. Device as recited in claim 26, wherein it has at least one pair of transport belts (17, 17', 18, 18', 19, 19', 20, 20') which interact such that the material (3) can be transported between them.

29. Device as recited in claim 23, wherein one pair (18, 18') of transport belts is used for feed, one angularly adjustable pair (19, 19') of transport belts is used to produce the offset (2) and one pair (20, 20') of transport belts is used for discharge.

30. Device as recited in claim 28, wherein one pair (17, 17') of transport belts extends over all transport path sections (5, 6, 7), one pair (53 or 53') of rollers at a time being located on the ends of the transport belts (17, 17') for guiding and driving them and in between there being an offset generating device (10) which acts on the pair (17, 17') of transport belts and at least one of the pairs (53 or 53') of rollers being made such that it accommodates the resulting offset (2) of the transport belts (17 and 17').

31. Device as recited in claim 30, wherein the offset generating device (10) consists of at least two guide surfaces (32) which at least impress deflections (8, 9) on the transport belts (17, 17').

32. Device as recited in claim 30, wherein the offset generating device (10) consists of at least two rotary elements (34, 40, 40') which are arranged such that they impress at least two deflections (8, 9 or 8, 8', 9, 9') on the transport belts (17, 17').

33. Device as recited in claim 30, wherein the pair (53 or 53') of guide rollers which is the second viewed in the transport direction (4) is supported to be able to move axially to accommodate the offset (2).

* * * * *